United States Patent [19]

Hinkle

[11] 4,146,084

[45] Mar. 27, 1979

[54] PROCESS AND APPARATUS FOR THE CYCLIC HEATING AND COOLING OF PROCESSING EQUIPMENT

[75] Inventor: Richard E. Hinkle, Bayshore, N.Y.

[73] Assignee: American Hydrotherm Corp., New York, N.Y.

[21] Appl. No.: 835,497

[22] Filed: Sep. 22, 1977

Related U.S. Application Data

[60] Division of Ser. No. 695,808, Jun. 14, 1976, Pat. No. 4,072,184, and a continuation-in-part of Ser. No. 690,166, May 26, 1976, Pat. No. 4,071,075.

[51] Int. Cl.[2] ..... F28D 21/00

[52] U.S. Cl. ..... 165/2; 165/18; 165/61; 165/104 S

[58] Field of Search ..... 165/104 S, 18, 2, 61; 126/400

[56] References Cited

U.S. PATENT DOCUMENTS

| | | | |
|---|---|---|---|
| 3,109,486 | 11/1963 | Hansen | 165/1 |
| 3,525,098 | 8/1970 | Vox | 165/2 |
| 3,556,201 | 1/1971 | Sander | 165/2 |
| 3,880,227 | 4/1975 | Bauer | 165/61 X |
| 4,020,895 | 5/1977 | Schafer | 165/18 X |
| 4,026,347 | 5/1977 | Schafer | 165/18 X |

*Primary Examiner*—Albert W. Davis, Jr.
*Attorney, Agent, or Firm*—Marn & Jangarathis

[57] ABSTRACT

There is disclosed a process and apparatus for the cyclic heating and cooling of processing equipment with a pressurized heat transfer fluid, i.e., water, utilizing heat exchangers for the separate heating and cooling of the heat transfer fluid and including a storage vessel having at least two heat transfer zones wherein heat transfer fluid is stored in such vessel during initial phases of one cycle for use in a subsequent cycle whereby heat transfer fluid at an intermediate temperature level in one zone is passed through such processing equipment prior to the passage of heated or cooled heat transfer fluid through such processing equipment from one of such heat exchangers.

7 Claims, 1 Drawing Figure

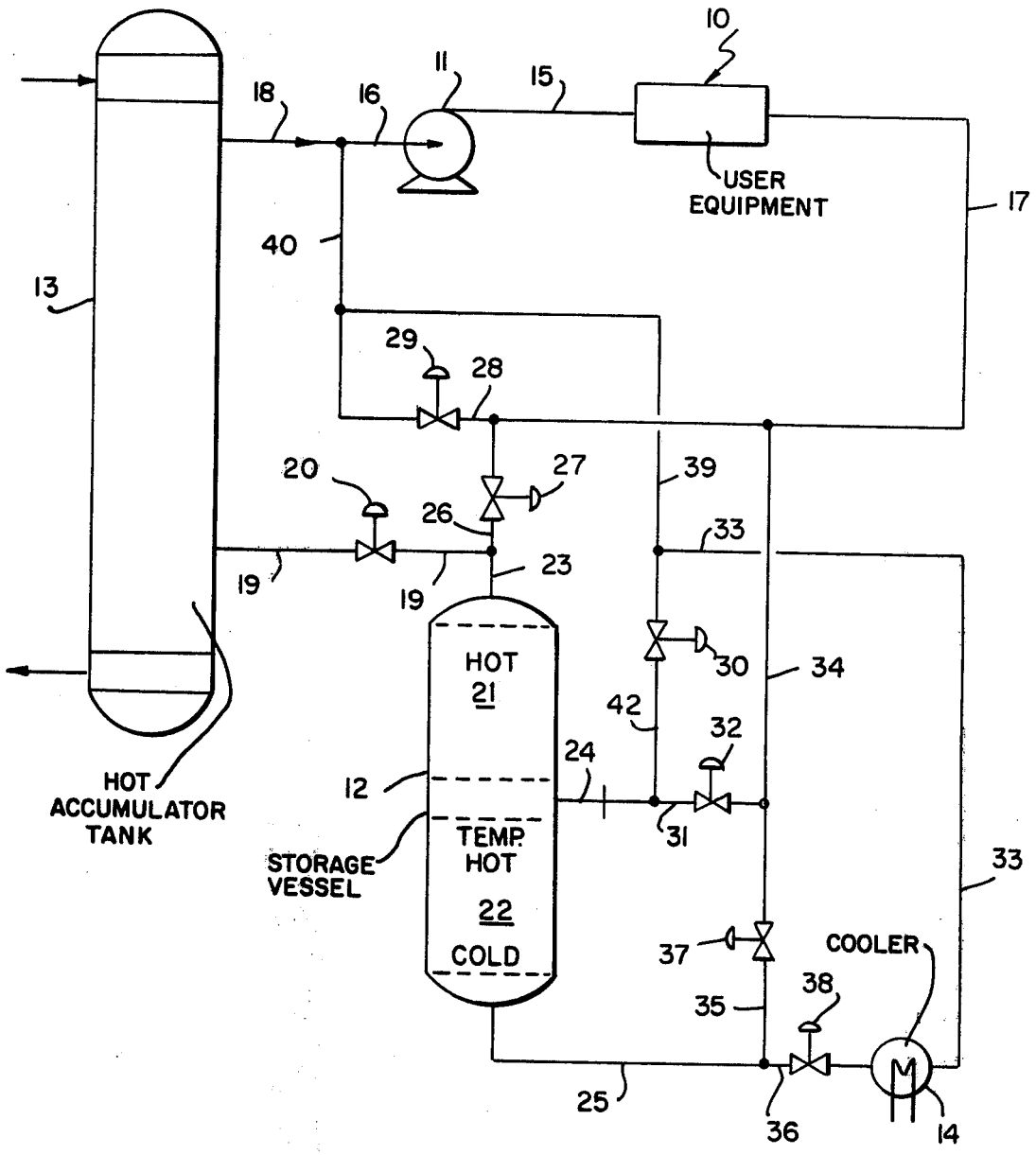
10
11
15
18
16
USER
EQUIPMENT
17
40
13
29
28
20
27
39
26
33
19
23
19
HOT
21
30
34
42
32
24
12
31
HOT
ACCUMULATOR
TANK
TEMP.
HOT
STORAGE
VESSEL
22
COLD
33
37
COOLER
38
35
25
36
14

PROCESS AND APPARATUS FOR THE CYCLIC HEATING AND COOLING OF PROCESSING EQUIPMENT

FIELD OF THE INVENTION

This is a division of application Ser. No. 695,808, filed 6/14/76, now U.S. Pat. No. 4,072,184, and a continuation-in-part of U.S. application Ser. No. 690,166, filed May 26, 1976, now U.S. Pat. No. 4,071,075 assigned to the same assignee as the present invention.

This invention relates to a process and apparatus for heating and cooling processing equipment, and more particularly to a process and apparatus for the cyclic heating and cooling of processing equipment utilizing pressurized water as the heat transfer fluid.

BACKGROUND OF THE INVENTION

In processing equipment, such as platen presses for producing decorative melamine and formaldehyde laminates, requiring alternate heating and cooling modes, most of the energy requirements are for heating and processing equipment rather than heating the material being processed. Furthermore, the alternate heating and cooling of such a heat transfer fluid adds substantially to the energy requirements of the process.

Early efforts to conserve heat were relatively simple. For example, at the end of a heating cycle, the hot fluid was set aside for use in heat-up of the next heating cycle and in like manner, at the end of a cooling cycle, the cold fluid was set aside and stored for use in cool-down at the start of a subsequent cooling cycle. This was facilely accomplished with an unpressurized water by use of separate vessels for the hot and cold fluid, with a pressurized water, the same vessel must be used, alternating hot and cold fluids and thereby introducing inefficiencies as a result of cross mixing.

In U.S. Pat. No. 3,109,486, there is disclosed a system including a "regenerative" section which contained relatively cooler water during the heating cycle which, on the start of a cooling cycle, is pumped through a heat exchanger for further cooling and thence through the processing equipment wherein heat is exchanged by the fluid while cooling the equipment. The fluid is then returned to the regenerative section. When the water temperature leaving the processing equipment becomes too low to be economically stored, the regenerative section is then by-passed. Thus, at the end of the cooling cycle, the regenerative section contains hot water originally in the piping and equipment plus some additional water which has first been cooled and then reheated in cooling equipment. The cycle is similar on heating, except that relatively warmer water in the regenerative section is upwardly displaced into the main section of the accumulator with the hottest water from the accumulator being circulated through the press, cooled and returned to the regenerative section.

The heat saved during a heating cycle is readily calculated by multiplying the mass of high pressure water in the regenerative section by the specific heat and the temperature difference between the start and finish of the heating cycle. The efficiency is adversly affected by using hottest water at the beginning of a heating cycle and cooling water before introduction during a cooling cycle, i.e., inefficiencies result by using heated or cooled water over large temperatures.

OBJECTS OF THE INVENTION

It is an object of the present invention to provide a novel process and apparatus for heating and cooling processing equipment.

Another object of the present invention is to provide a novel process and apparatus for heating and cooling processing equipment to substantially reduce over-all energy requirements.

Still another object of the present invention is to provide a novel process and apparatus for heating and cooling processing equipment to materially reduce piping, valving and equipment requirements.

Various other objects and advantages of the present invention will become apparent from the following detailed description of an exemplary embodiment thereof with the novel features thereof being particularly pointed out in the appended claims.

SUMMARY OF THE INVENTION

In accordance with the present invention, there is provided for processing equipment to be heated and cooled, heat exchangers for separately heating and cooling pressurized water, i.e., water under a pressure of at least about 30 psig, and including a storage vessel having at least two heat transfer zones wherein pressurized water is stored in such zones during initial phases of one cycle for use during initial phases of a subsequent cycle whereby heat transfer fluid at an intermediate temperature level in one of such zones is passed through the processing equipment prior to the passage through such processing equipment of heated or cooled pressurized water from one of such heat exchanger, as more clearly hereinafter disclosed. In accordance with my invention, the efficiency of heat recovery is substantially improved (40 to 45%) by such two stage change of water whereby water in the processing equipment is first displaced by tempered water from a first vessel and then replacing the tempered water after exchanging heat with the equipment, with water which is fully heated or cooled with such tempered water being stored in a second vessel, as distinguished from no recovery system, and substantially improves the effectiveness (at least about 100%) as compared with a recovery system, such as disclosed in the hereinabove mentioned Hanson reference.

In exchanging heat with the process equipment, the tempered water can be heated to a higher temperature while cooling the equipment and cooled to a lower temperature in heating the equipment than could fully heated or fully cooled water. Since the quantity of heat recovered varies with the difference between the two final temperatures, heat is more efficiently recovered.

The volume of each of the heat transfer zones is between 75 to 125 percent, preferably substantially about equal to the volume of the heat transfer conduits within the processing equipment and the volume of conduits to and from such processing equipment.

DESCRIPTION OF THE DRAWING

The invention will be more clearly understood by reference to the following detailed description of the preferred embodiment thereof when taken in conjunction with the accompanying drawing which is a schematic flow diagram thereof.

DETAILED DESCRIPTION OF THE INVENTION

Referring now to the drawing, the process and apparatus for heating and cooling processing equipment includes user equipment, generally indicated as 10, such as platen press for decorative laminates, a pump 11, storage vessel 12, hot accumulator tank 13 and a cooler 14. The user equipment 10 is connected to the discharge side of the pump 11 by a conduit 15 with the suction side of the pump 11 being connected to a conduit 16. The downstream side of the user equipment 10 is connected to a conduit 17. The outlet of the hot accumulator tank 13 is connected by a conduit 18 to the conduit 16 with the inlet to the hot accumulator tank 13 being connected to a conduit 19 under the control of valve 20.

The heat recovery vessel 12 includes upper and lower heat transfer zones 21 and 22, respectively, and is provided with upper intermediate and lower conduits 23, 24, and 25, respectively. The upper conduit 23 of the vessel 12 is connected to the conduit 19, and to a conduit 26 under the control of valve 27 with conduit 26 being connected to a conduit 28 under the control of valve 29. The intermediate conduit 24 of the vessel 12 is connected to a conduit 29 under the control of a valve 30 and to a conduit 31 under the control of valve 32 with conduit 29 being connected by a conduit 33 in fluid communication with the downstream side of cooler 14 and with conduit 31 being connected by conduit 34 to the conduit 17.

The lower conduit 25 of the vessel 12 is connected to conduits 35 and 36 under the control of valves 37 and 38, respectively. The conduit 35 is connected to the conduit 34 with conduit 36 being in fluid communication with the inlet side of the cooler 14. The conduits 29 and 33 are joined to a conduit 39 which is connected to conduit 28. The conduits 28 and 39 are connected by a conduit 40 to the conduit 16.

In operation, assuming initiation of a heating cycle in tempered water has been previously stored in the lower heat transfer zone 22 of the vessel 12, in a first stage of a heating cycle, the suction side of the pump 11 is placed in fluid communication with the upper portion of the lower heat transfer zone 22 of the vessel 12 via conduits 24, 29, 39, 40 and 16 by opening the valve 30. The discharge side of the pump 11 is in fluid communication with the user equipment 10 by the conduit 15 with the downstream side of the user equipment being in fluid communication with the lower portion of the lower heat transfer zone 22 of the vessel 12 via conduits 17, 34, 35 and 25 by opening valve 37 whereby tempered water in the upper portion of the vessel 12 is caused to be displaced by cooler water flowing upwardly within the vessel 12 since the user equipment had been operating within final stages of the cooling cycle. The valves 20, 27, 29 and 32 being closed.

As hereinabove mentioned, the volume of the heat transfer zones 21 and 22 is between 75 to 125 percent, preferably substantially about equal to the volume of the heat transfer conduits within the user equipment 10 and the conduits to and from such user equipment. Thus, after a corresponding volumetric replacement, the valve 37 is closed and the valves 20 ad 32 are opened to permit initiation of a second stage of the heating cycle whereby hot water from the accumulator tank 13 is introduced via conduits 18, 16, and 15 into the user equipment 10. Tempered cold water is withdrawn from user equipment 10 via conduits 17, 34, 31 and 24 and is introduced into the intermediate portion of the vessel 12 to displace upwardly into the accumulator tank 13 hot water from the upper heat transfer zone 21 of the vessel 12. Second stage heating is effected for a time sufficient to volumetric similarly substantially replace the pressurized water in the heat transfer conduits of the user equipment as well as the associated conduits. It will be appreciated that heat-up times are improved by passing the water stored in upper heat transfer zone 21 of the vessel 12 to hot accumulator tank 13 vice passage through the user equipment 10.

The final stage of the heating cycle is effected by closing valve 32 and opening valve 27 and gradually opening valve 29 whereby hot heat transfer fluid is withdrawn from the accumulator tank 13 by conduit 18 and combined in conduit 16 with recirculating heat transfer medium in conduit 40 and introduced by conduit 15 into user equipment 10. The heat transfer fluid withdrawn from the user equipment 10 in conduit 17 is split with a portion being passed to hot accumulator tank 13 by conduits 26 and 19 with the remaining portion by-passing accumulator tank 13 by being passed by conduit 28 to conduit 40 as the recirculating heat transfer fluid. The amount of heat transfer fluid by-passing the hot accumulator tank 13 is nominal, if any, at initiation of the final heating stage and is increased as the desired temperature level is reached with concomitant reductions in the flow of fluid from accumulator tank 13.

After a time period determined by the capabilities of the user equipment 10 with regard to the materials being treated, the heating cycle is stopped and first stage of the cooling cycle is initiated. Accordingly, valves 20 and 29 are closed and valve 30 is opened to permit hot heat transfer fluid from the user equipment 10 to be introduced by conduits 17, 26, and 23 into the upper portion of the heat recovery zone 21 of the vessel 12 to displace downwardly thereby tempered cold heat transfer fluid therein, such displaced fluid being passed to the user equipment 10 by conduits 24, 29, 39, 40, 16 and 15.

As hereinabove discussed with respect to first and second stages of the heating cycle, after a volume of heat transfer fluid is displaced equal to from 75 to 125 percent, preferably substantially equal to the volume of fluid in the user equipment 10 and related conduits, the second stage of the cooling cycle is initiated by closing valves 27 and 30 and by opening valves 32 and 38. Cobalt heat transfer fluid is passed by conduits 33, 39, 40, 16 and 15 to user equipment 10 with tempered hot fluid introduced into the intermediate portion of vessel 12 by conduits 17, 34, 31 and 24 to downwardly displace in the lower heat transfer zone 22 therein cold water which is passed to cooler 14 by conduits 25 and 36.

After a similar volumetric change, the final stage of the cooling cycle is effected by closing valve 32 and opening valve 37 whereby cooled heat transfer fluid continues to be passed to user equipment 10 from cooler 14 by conduits 33, 39, 40, 16 and 15 with tempered heat transfer fluid being returned to cooler 14 by conduits 17, 34, 35 and 36. During such final cooling stage valve 29 is caused to be gradually opened to effect a by-pass of a portion of the heat transfer to the cooler 14 as the user equipment reaches its lower design temperature. The by-passed fluid is passed from conduit 17 to conduit 40 by line 28 under the control valve 29. The amount of fluid by-passing the cooler 14 is increased as such final design temperature is reached. After a time period similarly dictated by process requirements, the cooling cycle is discontinued and the heating cycle initiated as hereinabove discussed.

As will be appreciated by one skilled in the art, when introducing a hot heat transfer fluid into a heat transfer zone of the vessel 12, the hot fluid is introduced into the upper portion thereof to thereby downwardly displace relatively cooler heat transfer fluid whereas when introducing cool heat transfer fluid into a transfer zone of the vessel 12, the cooled fluid is introduced into the lower portion thereof to thereby upwardly displace warmer water. It will be further appreciated by one skilled in the art that mixing in the heat recovery vessels of the heat transfer medium at various temperature levels during fluid should be minimized.

The invention has been described with reference to the use of pressurized water as the heat transfer fluid, however, it will be appreciated that other heat transfer fluids may be used. The use of another heat transfer fluid is not contemplated except for a use requiring large temperature range, since such use is inefficient requiring extra volumes of fluid to the system as a result of the specific heat of such heat transfer fluids.

EXAMPLE OF THE INVENTION

A 5′ × 12′ platen press having 22 openings is operated with a heat requirement of $10.84 \times 10^6$ B.T.U. per cycle within a temperature range of from 90° to 290° F. Use of the process and apparatus of the present invention reduces heat requirements to $6.44 \times 10^6$ B.T.U. per cycle as compared to estimated heat requirements of 8.8 B.T.U. per cycle for a system like the one disclosed in the hereinabove mentioned Hanson patent. Savings in energy requirements in the first year are greater than the additional equipment costs to effect such efficiencies.

While not fully illustrated, the valving arrangement includes automatic on-off and modulating valves in combination to minimize valve requirements.

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

I claim:

1. In a process for heating and cooling user equipment utilizing pressurized water as a heat transfer fluid in a closed system wherein said system includes heating and cooling zones for heating and cooling said heat transfer fluid and wherein said system includes a zone for storing heat transfer fluid at intermediate temperature levels, the improvement comprising:

(a) introducing heat transfer fluid from an upper portion of a first storage zone into said user equipment during a first stage of a heating cycle, said heat transfer fluid being at a temperature above the temperature of said user equipment;

(b) introducing heat transfer fluid withdrawn from said user equipment into a lower portion of said first storage zone during step (a) thereby upwardly displacing the heat transfer fluid therein;

(c) discontinuing the flow of heat transfer fluid to said first storage zone;

(d) introducing heat transfer fluid from said heating zone into said user equipment during a second stage of said heating cycle;

(e) introducing heat transfer fluid withdrawn from said user equipment during said second stage of said heating cycle into a lower portion of a second stage storage zone thereby displacing heat transfer fluid contained therein;

(f) passing said displaced heat transfer fluid of step (e) to said heating zone;

(g) switching to said heating zone the flow of heat transfer fluid withdrawn from said user equipment to initiate and finalize said heating cycle;

(h) discontinuing the flow of heat transfer fluid to said user equipment from said heating zone at completion of said heating cycle;

(i) subsequently introducing heat transfer fluid withdrawn from said user equipment into said upper portion of said second storage zone during a first stage of a cooling cycle thereby downwardly displacing heat transfer fluid therein, said heat transfer fluid being at a temperature below the temperature of said user equipment;

(j) withdrawing and passing to said user equipment, said displaced heat transfer fluid of step (i);

(k) discontinuing the flow of heat transfer to said second storage zone;

(l) introducing heat transfer fluid from said cooling zone into said user equipment during a second stage of said cooling cycle;

(m) introducing heat transfer fluid withdrawn from said user equipment during step (l) into said upper portion of said first storage zone therein by downwardly displacing heat transfer fluid therein;

(n) passing said displaced heat transfer fluid of step (m) to said cooling zone; and (o) switching the flow of heat transfer fluid withdrawn from said user equipment from said first storage zone to said cooling zone to initiate and finalize said cooling cycle.

2. The process as defined in claim 1 wherein the volume of heat transfer fluid in a storage zone is from 75 to 125 percent of the volume of transfer fluid in said user equipment and related conduit means.

3. The process as defined in claim 2 wherein said volumes are substantially about equal.

4. The process as defined in claim 1 wherein a first portion of said heat transfer fluid withdrawn from said user equipment, during finalization of said heating cycle is returned to said user equipment with the remaining portion being returned to said heating zone.

5. The process as defined in claim 4 wherein the ratio of first portion to remaining portion of said heat transfer fluid increases during completion of said heating cycle.

6. The process as defined in claim 1 wherein a first portion of said heat transfer fluid withdrawn from said user equipment, during finalization of said cooling cycle is returned to said user equipment with the remaining portion being returned to said cooling zone.

7. The process as defined in claim 6 wherein the ratio of said first portion to remaining portion of said heat transfer fluid increases during completion of said cooling cycle.

* * * * *